US012594639B2

(12) United States Patent
Dupuis et al.

(10) Patent No.: US 12,594,639 B2
(45) Date of Patent: Apr. 7, 2026

(54) WALK BEHIND GRINDING TOOL WITH HORIZONTALLY ALIGNED GUIDES AND GRINDING DRUM

(71) Applicant: CORNING RESEARCH & DEVELOPMENT CORPORATION, Corning, NY (US)

(72) Inventors: David Montalion Dupuis, Cedar Park, TX (US); Cary Alan Kipke, Pflugerville, TX (US); Donald Kent Larson, Cedar Park, TX (US)

(73) Assignee: CORNING RESEARCH & DEVELOPMENT CORPORATION, Corning, NY (US)

( * ) Notice: Subject to any disclaimer, the term of this patent is extended or adjusted under 35 U.S.C. 154(b) by 530 days.

(21) Appl. No.: 18/196,195

(22) Filed: May 11, 2023

(65) Prior Publication Data

US 2023/0278155 A1 Sep. 7, 2023

Related U.S. Application Data

(63) Continuation of application No. PCT/US2021/059338, filed on Nov. 15, 2021.
(Continued)

(51) Int. Cl.
*B24B 7/18* (2006.01)
*E01C 23/09* (2006.01)

(52) U.S. Cl.
CPC ..... *B24B 7/188* (2013.01); *E01C 23/09* (2013.01)

(58) Field of Classification Search
CPC ..... B24B 7/188; E01C 23/09
(Continued)

(56) References Cited

U.S. PATENT DOCUMENTS 1,529,797 A * 3/1925 Gray ..... A01B 29/02 404/124
3,398,989 A * 8/1968 Christensen ..... B28D 1/186 451/547

(Continued)

FOREIGN PATENT DOCUMENTS

WO 2012/030994 A2 3/2012
WO 2020/112438 A1 6/2020

OTHER PUBLICATIONS

Extended European Search Report, EP application No. 21898921.8, dated Oct. 1, 2024, 8 pages, European Patent Office.

(Continued)

*Primary Examiner* — Raymond W Addie
(74) *Attorney, Agent, or Firm* — William D. Doyle

(57) ABSTRACT

Disclosed herein are walk behind grinding tools with horizontally aligned guides and grinding drum. One embodiment relates to a grinding tool with a pair of guides on opposing sides of a blade set of a grinding drum, where the pair of guides is configured to limit a grinding depth of the grinding drum. At least a portion of a guide curvature is generally concentric with a mill curvature, and a guide radius is less than a mill radius. Another embodiment relates to a grinding system including a grinding tool with a vacuum shroud hingedly attached to a front of a main body of a grinding housing, and a vacuum including a vacuum tube in fluid communication with the vacuum shroud. Another embodiment relates to a method of forming a grinding tool.

20 Claims, 13 Drawing Sheets

Related U.S. Application Data

(60) Provisional application No. 63/117,662, filed on Nov. 24, 2020.

(58) Field of Classification Search
USPC ..... 404/72, 75, 94, 96
See application file for complete search history.

(56) References Cited

U.S. PATENT DOCUMENTS 3,554,606 A * 1/1971 Mabey et al. ..... E01C 23/088 451/547
4,174,184 A * 11/1979 Heenan ..... E01F 9/553 404/94
4,900,094 A * 2/1990 Sergeant ..... B27B 33/20 404/90
5,676,490 A * 10/1997 Nelson ..... E01C 23/0993 404/94
5,882,086 A 3/1999 Bremner et al.
7,223,049 B2 * 5/2007 Hall ..... E01C 23/0885 404/93
2004/0005190 A1 * 1/2004 Jakits ..... E01C 23/0993 404/94
2004/0148823 A1 8/2004 Schenk
2005/0268900 A1 12/2005 Markley et al.
2006/0233615 A1 10/2006 Searby
2011/0020063 A1 * 1/2011 Abresch ..... E01C 23/0993 404/94
2013/0011198 A1 1/2013 Pichler et al.
2016/0221222 A1 8/2016 Jenkins

OTHER PUBLICATIONS

International Search Report and Written Opinion of the International Searching Authority; PCT/US2021/059338; dated Feb. 8, 2022; pp. 13; International Searching Authority.

* cited by examiner

WALK BEHIND GRINDING TOOL WITH HORIZONTALLY ALIGNED GUIDES AND GRINDING DRUM

CROSS-REFERENCE TO RELATED APPLICATION

This application is a continuation of International Application No. PCT/US2021/059338 filed Nov. 15, 2021, which claims the benefit of priority under 35 U.S.C. § 119 of U.S. Provisional Application Ser. No. 63/117,662, filed on Nov. 24, 2020, the content of which is relied upon and incorporated herein by reference in its entirety.

BACKGROUND

The present disclosure relates to a grinding tool. In particular, the present disclosure relates to a walk behind grinding tool with horizontally aligned guides and grinding drum.

Fiber to the premises (FTTP) has increased in popularity as improvements in micro-trenching have provided greater reliability and increased efficiency. However, micro-trenching often requires removal of large amounts of material with large and expensive equipment that limits micro-trench locations (e.g., curbs) and results in substantial debris that requires frequent and costly disposal. Alternatively, other processes may be used to form a nano-trench in the pavement, position a fiber optic cable therein, and cover with road tape, which reduces time and cost of deploying fiber networks.

Such processes are often limited in the creation of a consistent and precise nano-trench due to a limit in controlling the size and shape of the nano-trench. This may produce vulnerabilities in the fiber optic cable and/or road tape. For example, FIG. 1 is a side view of a grinding machine 100 with a grinding drum 102 positioned between a front wheel 104 and rear wheels 106. Such a configuration produces a grind of a desired depth when traveling over a flat surface 108, but produces a shallow grind when traveling over a valley 108' between the front wheel and the rear wheels, and produces a deep grind when traveling over a crest 108" between the front wheel 104 and the rear wheels 106. In other words, the grinding machine 100 cannot adequately adapt to road contours to produce a consistent nano-trench depth because of the horizontal offset of the axis of the wheels 104, 106 from the axis of the grinding drum 102. Accordingly, such grinding machines cannot produce consistent and precise nano-trenches over a wide variety of road contours or other terrain.

SUMMARY

One embodiment of the disclosure relates to a grinding tool including a grinding housing, a grinding drum, and a pair of guides. The grinding drum includes an axle and a blade set mounted thereto. The blade set includes at least one channel blade and a plurality of milling blades on opposing sides of the at least one channel blade. The axle is rotatably coupled to the grinding housing. Rotation of the plurality of milling blades defines a mill curvature and a mill radius about a mill axis. The pair of guides are on opposing sides of the blade set, and is configured to limit a grinding depth of the grinding drum. Each of the pair of guides defines a guiding curvature and a guide radius about a guide axis, at least a portion of the guide curvature being generally concentric with the mill curvature. The guide radius is less than the mill radius.

An additional embodiment of the disclosure relates to a grinding system, including a grinding tool and a vacuum. The grinding tool includes a grinding housing, a grinding drum, a pair of guides, and a grinding motor. The grinding housing includes a main body and a vacuum shroud hingedly attached to a front of the main body. The grinding drum includes an axle and a blade set mounted thereto. The blade set includes at least one channel blade and a plurality of milling blades on opposing sides of the at least one channel blade. The axle is rotatably coupled to the grinding housing. Rotation of the plurality of milling blades defines a mill curvature and a mill radius about a mill axis. The pair of guides are on opposing sides of the blade set, and is configured to limit a grinding depth of the grinding drum. Each of the pair of guides defines a guiding curvature and a guide radius about a guide axis. At least a portion of the guide curvature being generally concentric with the mill curvature. The guide radius is less than the mill radius. The grinding motor is attached to a side of the grinding housing and configured to rotate the grinding drum. The vacuum includes a vacuum tube in fluid communication with the vacuum shroud.

An additional embodiment of the disclosure relates to a method of forming a grinding tool. The method includes at least partially positioning a grinding drum in a grinding housing. The grinding drum includes an axle and a blade set mounted thereto. The blade set includes at least one channel blade and a plurality of milling blades on opposing sides of the at least one channel blade. The axle is rotatably coupled to the grinding housing. Rotation of the plurality of milling blades defines a mill curvature and a mill radius about a mill axis. The method further includes assembling a pair of guides on opposing sides of the blade set, the pair of guides configured to limit a grinding depth of the grinding drum. Each of the pair of guides defines a guiding curvature and a guide radius about a guide axis. At least a portion of the guide curvature is generally concentric with the mill curvature. The guide radius is less than the mill radius.

Additional features and advantages will be set out in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Figure 1:
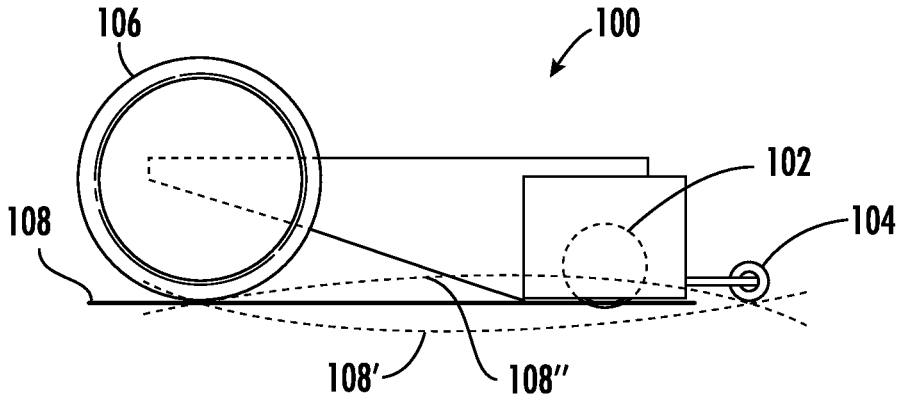
FIG. 1 is a side view of a grinding machine with a grinding drum positioned between a front wheel and rear wheels.

Reference will now be made in detail to the present preferred embodiments, examples of which are illustrated in the accompanying drawings. Whenever possible, the same reference numerals will be used throughout the drawings to refer to the same or like parts.

The embodiments set out below represent the information to enable those skilled in the art to practice the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The use herein of ordinals in conjunction with an element is solely for distinguishing what might otherwise be similar or identical labels, such as "first layer" and "second layer," and does not imply a priority, a type, an importance, or other attribute, unless otherwise stated herein.

The term "about" used herein in conjunction with a numeric value means any value that is within a range of ten percent greater than or ten percent less than the numeric value.

As used herein, the articles "a" and "an" in reference to an element refers to "one or more" of the element unless otherwise explicitly specified. The word "or" as used herein is inclusive unless contextually impossible. As an example, the recitation of A or B means A, or B, or both A and B.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

The use herein of "proximate" means at, next to, or near.

The terms "left," "right," "top," "bottom," "front," "back," "horizontal," "parallel," "perpendicular," "vertical," "lateral," "coplanar," and similar terms are used for convenience of describing the attached figures and are not intended to limit this disclosure. For example, the terms "left side" and "right side" are used with specific reference to the drawings as illustrated and the embodiments may be in other orientations in use. Further, as used herein, the terms "horizontal," "parallel," "perpendicular," "vertical," "lateral," etc., include slight variations that may be present in working examples.

Figure 2A:
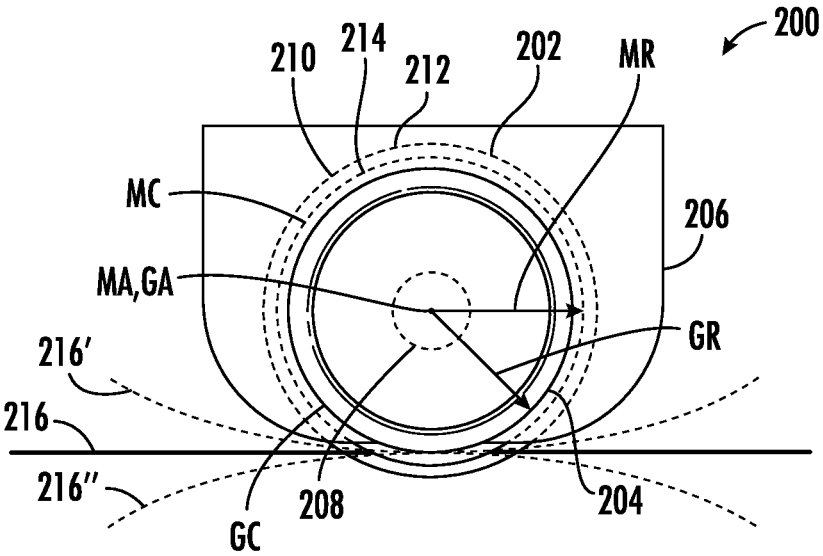
FIG. 2A is a side view of a grinding apparatus with a grinding drum positioned between and horizontally aligned with two guides.
Figure 2B:
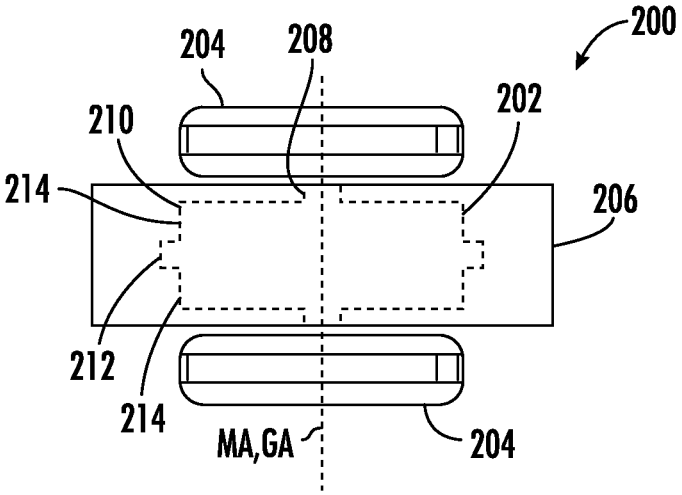
FIG. 2B is a top view of the grinding apparatus of FIG. 2A.

FIGS. 2A-2B are views of a grinding apparatus 200 with a grinding drum 202 positioned between and horizontally aligned with a pair of guides 204. In certain embodiments, the grinding apparatus 200 is a grinding machine or grinding tool including a housing 206 (e.g., grinding housing or housing body, etc.), the grinding drum 202, and the pair of guides 204. In certain embodiments, the grinding apparatus 200 includes a handle attached to the housing, such as used in a walk-behind grinding tool. In certain embodiments, the grinding apparatus 200 includes a vehicle mount attached to the housing to attach the housing to a vehicle, such as in a vehicle mounted grinding machine pushed by a vehicle (e.g., motorized vehicle, truck, etc.).

The grinding drum 202 includes an axle 208 and a blade set 210 mounted thereto. The blade set 210 includes at least one channel blade 212 and a plurality of milling blades 214 on opposing sides of the at least one channel blade 212. The axle 208 is rotatably coupled to the housing 206. Rotation of the plurality of milling blades 214 defines a mill curvature MC and a mill radius MR about a mill axis MA.

The pair of guides 204 (e.g., pair of wheels, skis, etc.) are on opposing sides of the blade set 210. The pair of guides 204 is configured to limit a grinding depth of the grinding drum 202. Each of the pair of guides 204 defines a guiding curvature GC and a guide radius GR about a guide axis GA. At least a portion of the guide curvature GC being generally concentric with the mill curvature MC. The guide radius GR is less than the mill radius MR. Each of the pair of wheels is horizontally aligned with the grinding drum 202. The mill axis MA of the grinding drum 202 is aligned (e.g., horizontally and/or axially) with the guide axis GA of the pair of guides 204, such as within 10 mm. At least a portion of the guide curvature GC is generally concentric with the mill curvature MC. The guide radius GR is less than the mill radius MR.

Positioning of the pair of guides 204 along the MA of the grinding drum 202 maintains a consistent depth regardless of pavement contour. In particular, such a configuration maintains a grind of a desired depth when traveling over a flat surface 216, a valley 216', and/or a crest 216". The grinding apparatus 200 adapts to road contours to produce a consistent nano-trench depth because of the horizontal alignment of the guide axis GA of the pair of guides 204 from the mill axis MA of the grinding drum 202. The pair of guides 204 and the grinding drum 202 are on the same centerline and/or in the same plane. The grinding apparatus 200

(without relying on front and back wheels for support during grinding) provides a consistent and precise nano-trench (e.g., consistent depth) over a wide variety of road contours or other terrain regardless of surface irregularities or variations (e.g., uneven surfaces, undulating surfaces, crests, valleys, road contours, curb contours, etc.).

Figure 3A:
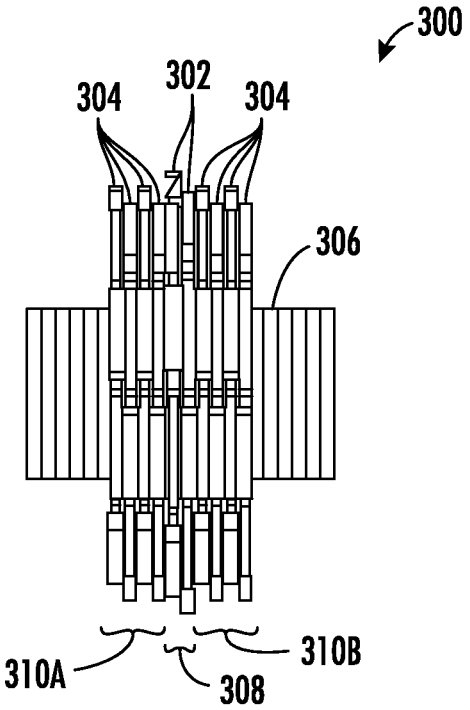
FIG. 3A is a front view of one embodiment of the grinding drum of FIGS. 2A-2B.
Figure 3B:
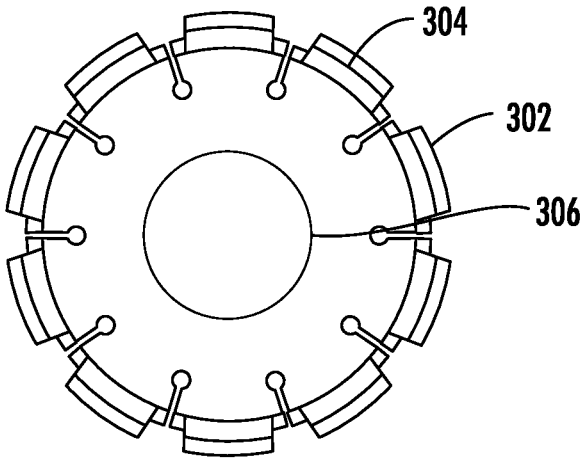
FIG. 3B is a side view of the grinding drum of FIG. 3A.

FIGS. 3A-3B are views of one embodiment of the grinding drum 202 of FIGS. 2A-2B. Grinding drum 300 provides for simultaneously milling both a channel and a recessed area on either side of the channel in a single pass. At least one channel blade 302 and a plurality of milling blades 304 is mounted on a blade axle 306. In certain embodiments, the at least one channel blade 302 and/or the plurality of milling blades 304 are diamond tipped, which provides for longer wear and fasting cutting. The at least one channel blade 302 is centered on the blade axle 306 and at least one milling blade 304 of the plurality of milling blades 304 is mounted on each side of the at least one channel blade 302. The at least one channel blade 302 and/or plurality of milling blades 304 fit securely on the blade axle 306. The at least one channel blades 302 have a larger radius than the plurality of milling blades 304 to provide a predetermined depth of the channel relative to the recess.

In certain embodiments, the at least one channel blade 302 includes a set 308 of channel blades 302 centrally mounted on the blade axle 306, the plurality of milling blades 304 includes a first set 310A of four milling blades 304 mounted directly on one side of the set 308 of channel blades 302, and a second set 310B of four milling blades are mounted on the other side of the set 308 of channel blades 302. Of course, more or fewer channel blades 302 and/or milling blades 304 may be used depending on the application.

In certain embodiments, the set 308 of channel blades 302 includes only one channel blade 302 (e.g., 0.25 inches wide). Grind smoothness is determined by spacing between the cutting blades (e.g., the channel blades 302 and/or the milling blades 304). In certain embodiments, washers are used to space the channel blades 302 and/or the milling blades 304; where thicker washers provide a more corrugated grind finish, and thinner washers provide a smoother grind finish. In certain embodiments, spacer washers are provided on either side of the channel blades 302 (i.e., between the channel blades 302 and the milling blades 304).

Figure 4A:
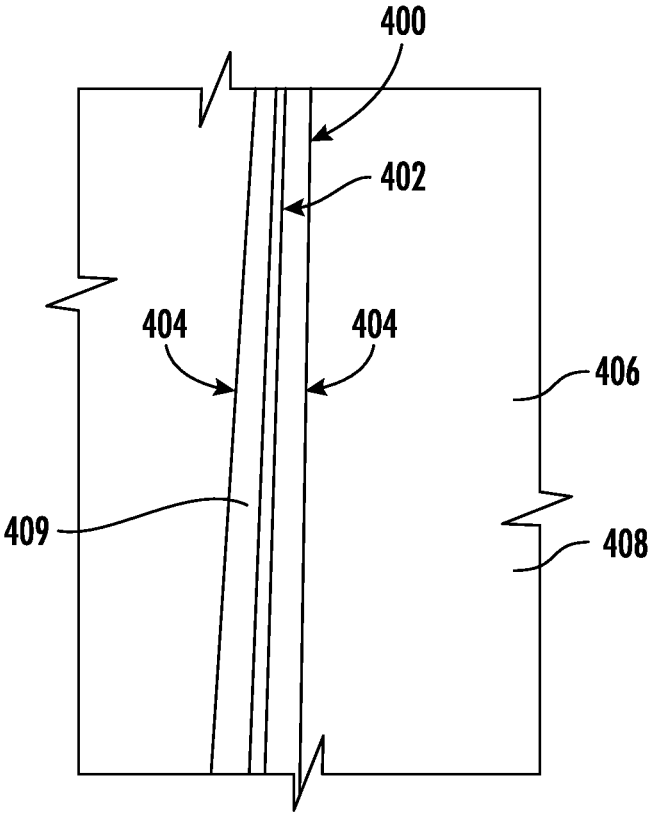
FIG. 4A is a perspective view of a nano-trench including a channel and a recess milled by the grinding drum of FIGS. 3A-3B.

FIG. 4A is a perspective view of a nano-trench 400 including a channel 402 and recesses 404 (may also be referred to as a recessed area, milled recess, etc.) milled by the grinding drum 300 of FIGS. 3A-3B. Use of the grinding drum 300 provides for a single-pass process that symmetrically produces the channel 402 and the recesses 404 on either side of the channel 402 within a substrate 406. The channel 402 and the recesses 404 of the nano-trench 400 form a T-slot feature, although other shaped nano-trenches may be formed. The substrate 406 is milled to include a recess 404 that is wider than the channel 402, below an upper surface 408 of the substrate 406 the channel 402. The substrate 406 may be any type or of any material (e.g., asphalt, concrete, pavement, road, curb, walkway, bridge support, building base, etc.).

Figure 4B:
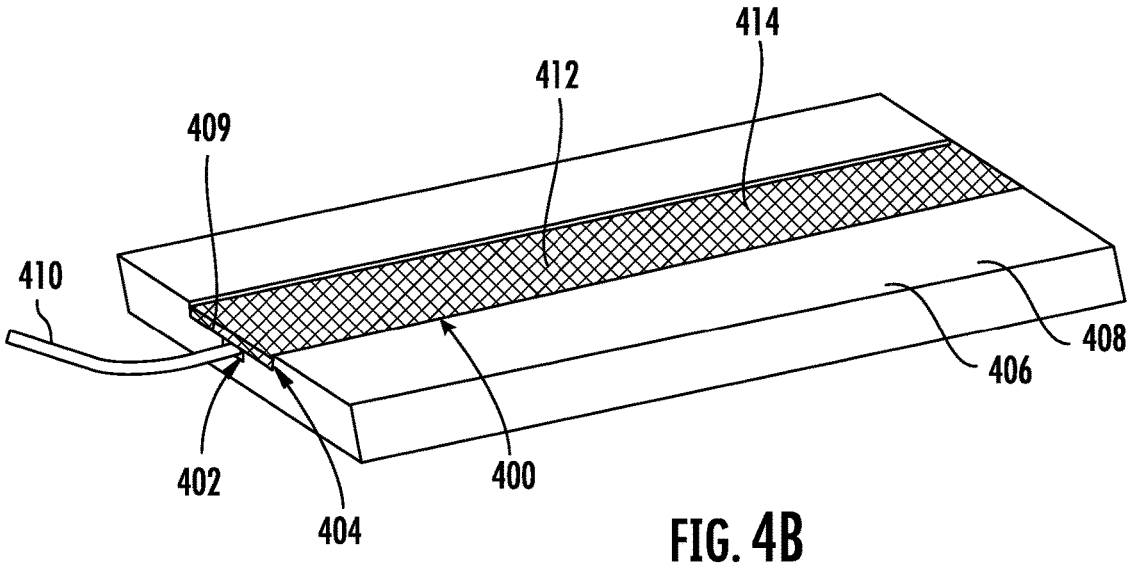
FIG. 4B is a perspective view of a distribution cable within the channel and cabling tape in the recess of the nano-trench of FIG. 4A.
Figure 4C:
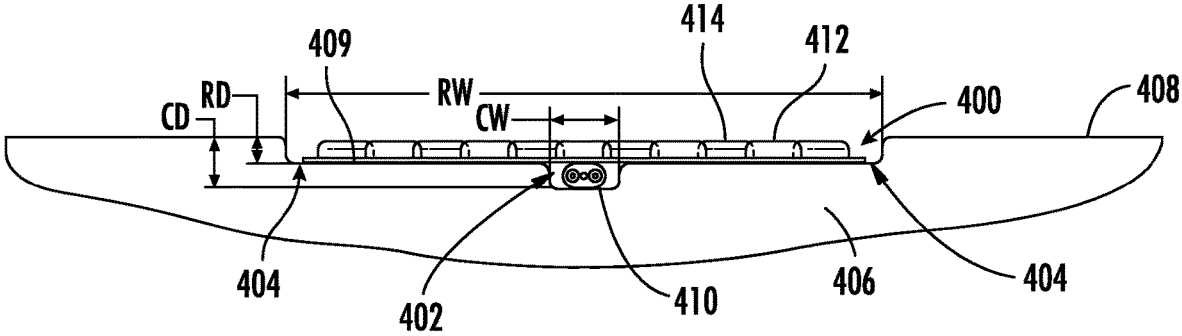
FIG. 4C is a cross-sectional side view of the cabling tape, distribution cable, and nano-trench of FIG. 4B.

FIGS. 4B-4C are views of a distribution cable 410 within the channel 402 and a cabling tape 412 in the recess 404 of the nano-trench 400 of FIG. 4A. Once the nano-trench 400 is formed, the distribution cable 410 is placed within the channel 402, and then the cabling tape 412 is placed in the recess 404 over the channel 402 and the distribution cable 410. Such work can be performed even if the substrate 406 is wet, as grinding exposes a new, dry surface for adherence of the cabling tape 412. The channel 402 protects the distribution cable 410, such as from road surface impact. The cabling tape 412 is durable and covers and protects the distribution cable 410. In certain embodiments, the channel 402 may be adhesive free or may include some amount of adhesive to hold the distribution cable 410 in place during deployment and/or to provide a water sealant and/or water blocking material.

The cabling tape 412 covers the distribution cable 410 and is adhered to the substrate 406 within the recess 404 such that an exposed upper surface 414 of the cabling tape 412 may sit substantially flush with or slightly below the upper surface 408 of the substrate 406. The cabling tape 412 is configured to adhere to the substrate 406. The cabling tape 412 may include an adhesive layer that is capable of adhering to the substrate 406. In certain embodiments, an adhesive compound may be applied to the substrate 406 separately from the cabling tape 412, such that the cabling tape 412 is pressed into the adhesive for bonding to the substrate 406.

The distribution cable 410 fits entirely within the channel 402 and the upper surface 414 of the cabling tape 412 is flush with or slightly below the upper surface 408 of the substrate 406. In certain embodiments, the depth of the recess 404 impacts contact with vehicle tires, which affects durability and lifetime of the cabling tape 412.

A channel width CW of the channel 402 and a recess width RW of the recess 404 are determined by grinding drum 200, 300 (see FIGS. 2A-3A). Referring to FIGS. 3A and 4A-4C, the number of channel blades 302 used to form the channel 402 depends on the dimensions and/or orientation of the distribution cable 410. The number of milling blades 304 used to form the recess 404 depends on the width of the cabling tape 412. In other words, the width of the channel 402 can be adjusted by the number and/or width of the channel blades 302, and the width of the recess 404 can be adjusted by the number and/or width of the milling blades 304.

The profiles of the channel 402 and the recess 404 are slightly wider than the profiles of both the distribution cable 410 and the cabling tape 412, respectively. For example, in certain embodiments, the cabling tape 412 has a width of 0.5-4 inches and the recess width RW of the recess 404 is at least 0.25 inches larger (e.g., between 1-6 inches). In certain embodiments, the channel width CW of the channel 402 may be 0.25-2 inches wide (e.g., to accommodate different sized fiber optic cables and/or orientations). The channel 402 and/or the recess 404 can be any size and/or shape to accommodate additional cable(s), and similarly, the recess width RW could be wider or narrower to accommodate any size and/or shape the cabling tape 412.

The depth profile of the channel 402 and the recess 404 may be adjusted during milling, such as to maximize the protection of both the distribution cable 410 and cabling tape 412. In certain embodiments, a channel depth CD of the channel 402 from the lower surface 409 of the recess 404 to the upper surface 408 of the substrate 406 may be generally between 0.3 inches and 1 inch, and preferably about 0.35, 0.375, or 0.55 inches. A recess depth RD of the recess 404 from the lower surface 409 of the recess 404 to the upper surface 408 of the substrate 406 may be generally 0.1 inches to 0.5 inches, and preferably between 0.15 inches and 0.2 inches.

Figure 5:
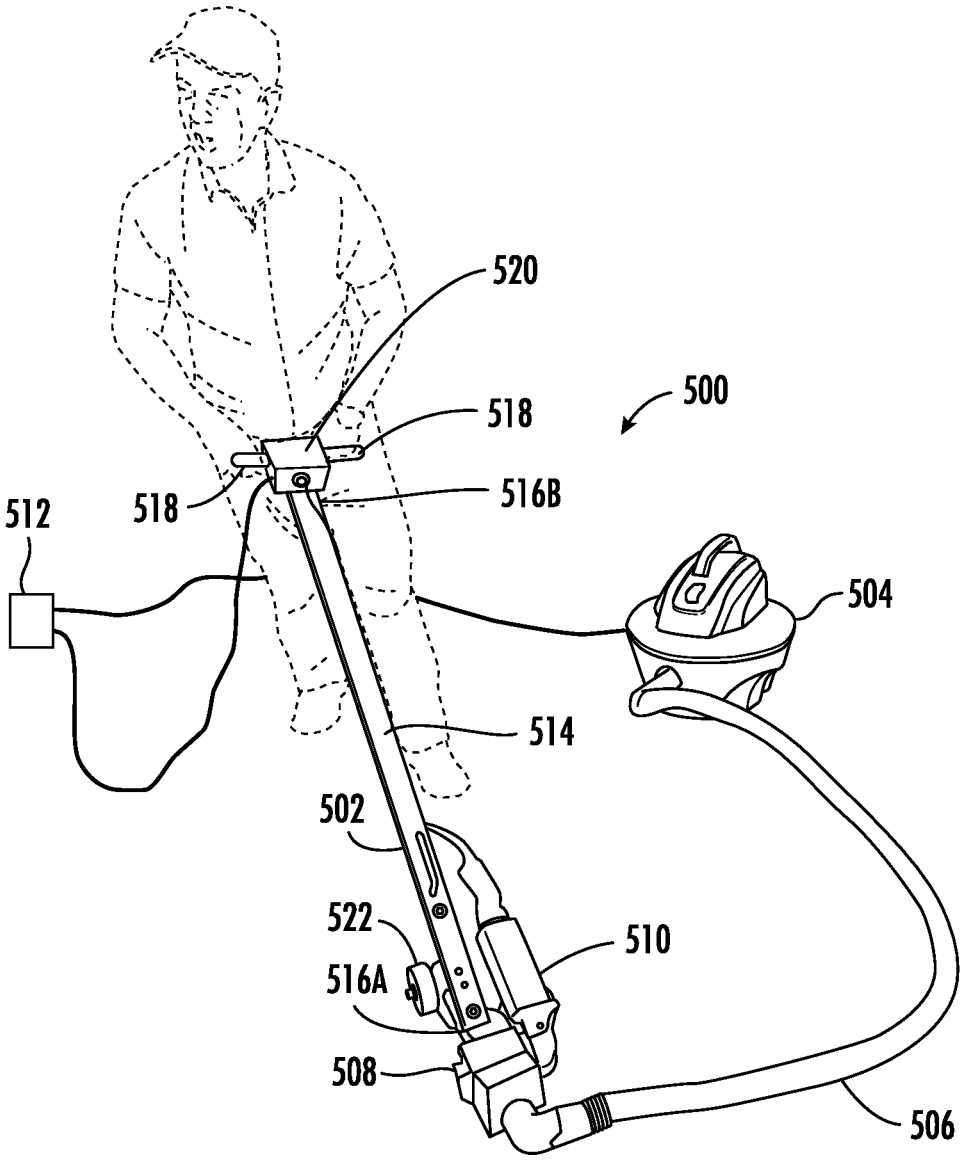
FIG. 5 is a perspective view of a grinding system including a walk behind grinding tool and a vacuum.

FIG. 5 is a perspective view of a grinding system 500 including a walk behind grinding tool 502 and a vacuum 504 (e.g., cyclone vacuum). The vacuum 504 is in fluidic communication with the grinding tool 502 by a vacuum tube 506 to suction out dust and debris created by the grinding tool 502. The grinding tool 502 includes a grinding housing 508, with a grinding motor 510 attached to the grinding housing 508. The grinding motor 510 is configured to rotate the grinding drum in the grinding housing 508 to grind the substrate 406. In certain embodiments, the grinding motor 510 is attached to a side of the grinding housing 508. The grinding motor 510 of the grinding tool 502 and/or the vacuum 504 are connected to a power source 512, such as an electrical outlet (e.g., 110 VAC). In certain embodiments, the grinding tool 502 and/or the vacuum 504 are powered by batteries and/or a gas engine. In certain embodiments, an automated vacuum switch (e.g., iVac switch box Model SB-NA) could be used to turn on the vacuum 504 when the grinding motor 510 is powered.

In certain embodiments, the grinding tool 502 includes a push handle 514 (may also be referred to as a walk-behind handle, etc.) attached to the grinding housing 508. The push handle 514 can be of any suitable length (e.g., longer, shorter, and/or angled) to provide a user with optimized ergonomics. In certain embodiments, the push handle 514 is attached to the grinding housing 508 at a first end 516A and includes handle bars 518 at a second end 516B opposite thereto. In certain embodiments, the grinding tool 502 includes a control interface 520 at the second end 516B of the push handle 514. The control interface includes at least one switch to control operation of the grinding motor 510. In certain embodiments, the grinding tool 502 includes a pair of pivot wheels 522 (or only one wheel) attached to the push handle 514 (between the first end 516A and the second end 516B) and positioned rearward of the grinding housing 508. In certain embodiments, the pair of wheels 522 is configured to assist in transport of the grinding tool 502, and are held off the ground during operation of the grinding tool 502.

Figure 6A:
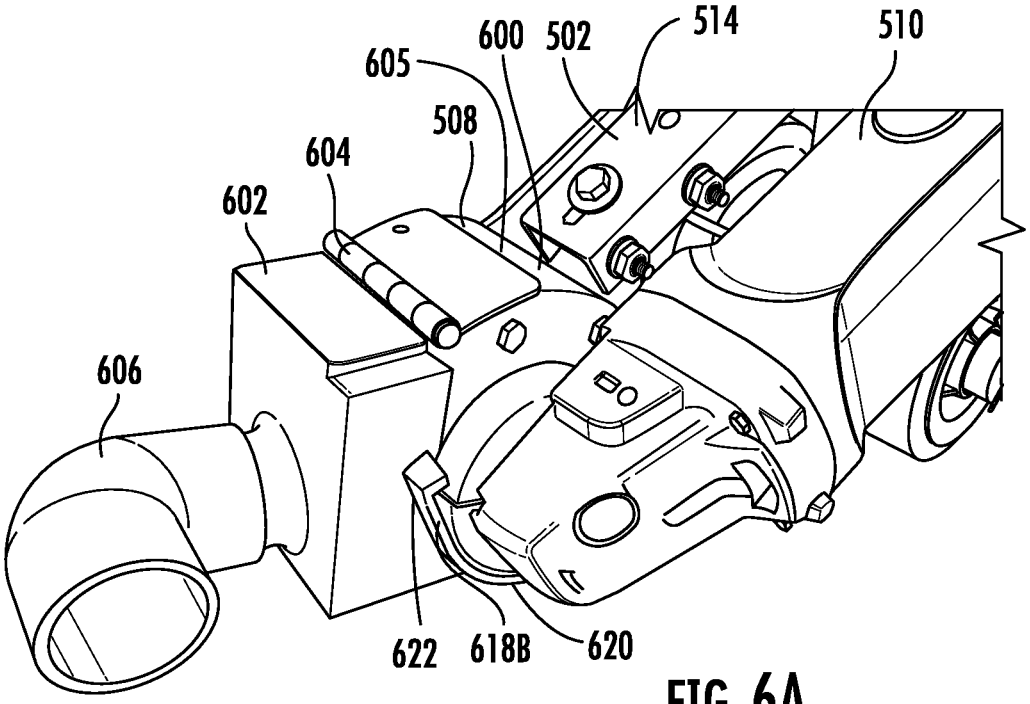
FIG. 6A is a right perspective view of a grinding house and a grinding motor of the walk behind grinding tool of FIG. 5.
Figure 6B:
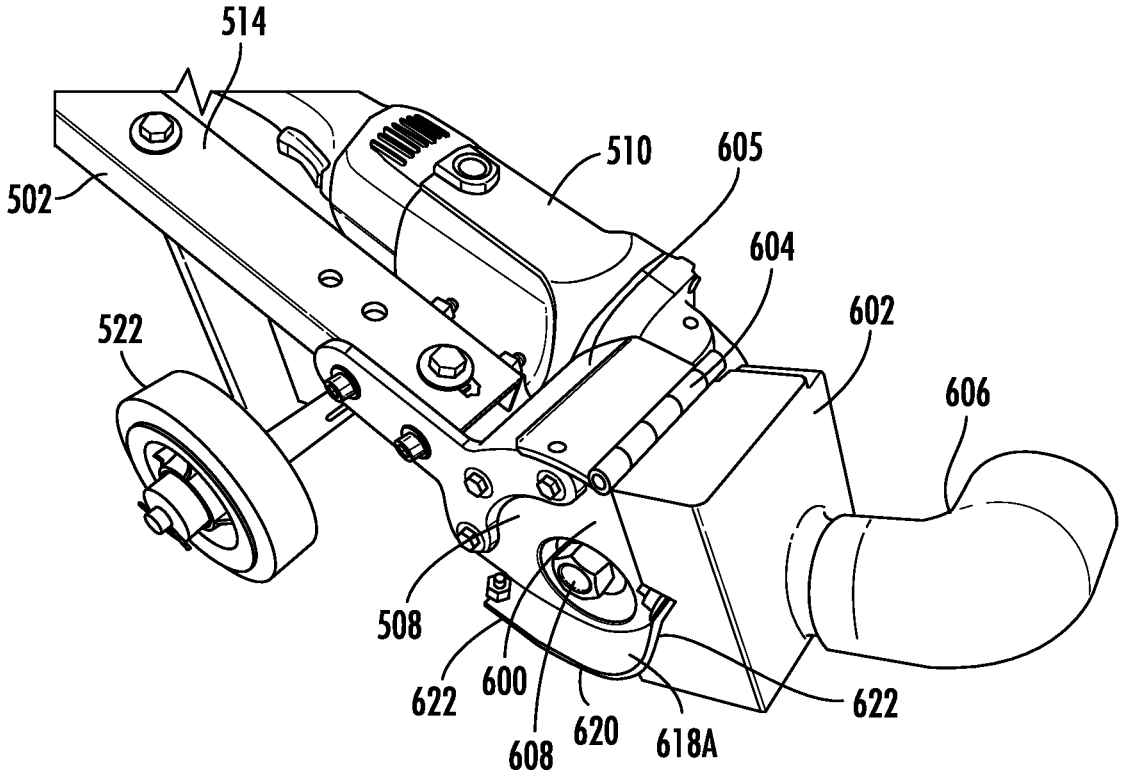
FIG. 6B is a left perspective view of the grinding house and the grinding motor of FIG. 6A.
Figure 6C:
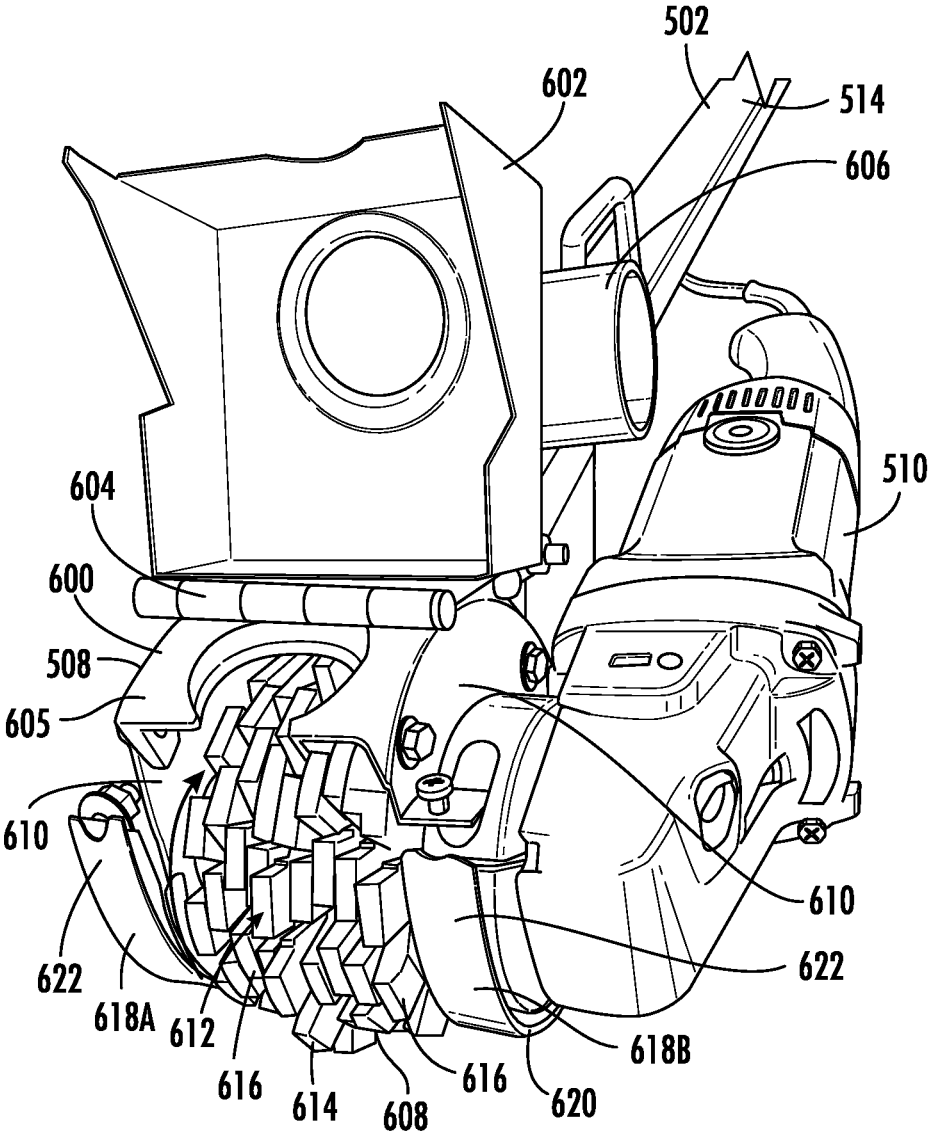
FIG. 6C is a front perspective view of the grinding house of FIGS. 6A-6B with a front vacuum shroud in an open orientation.
Figure 6D:
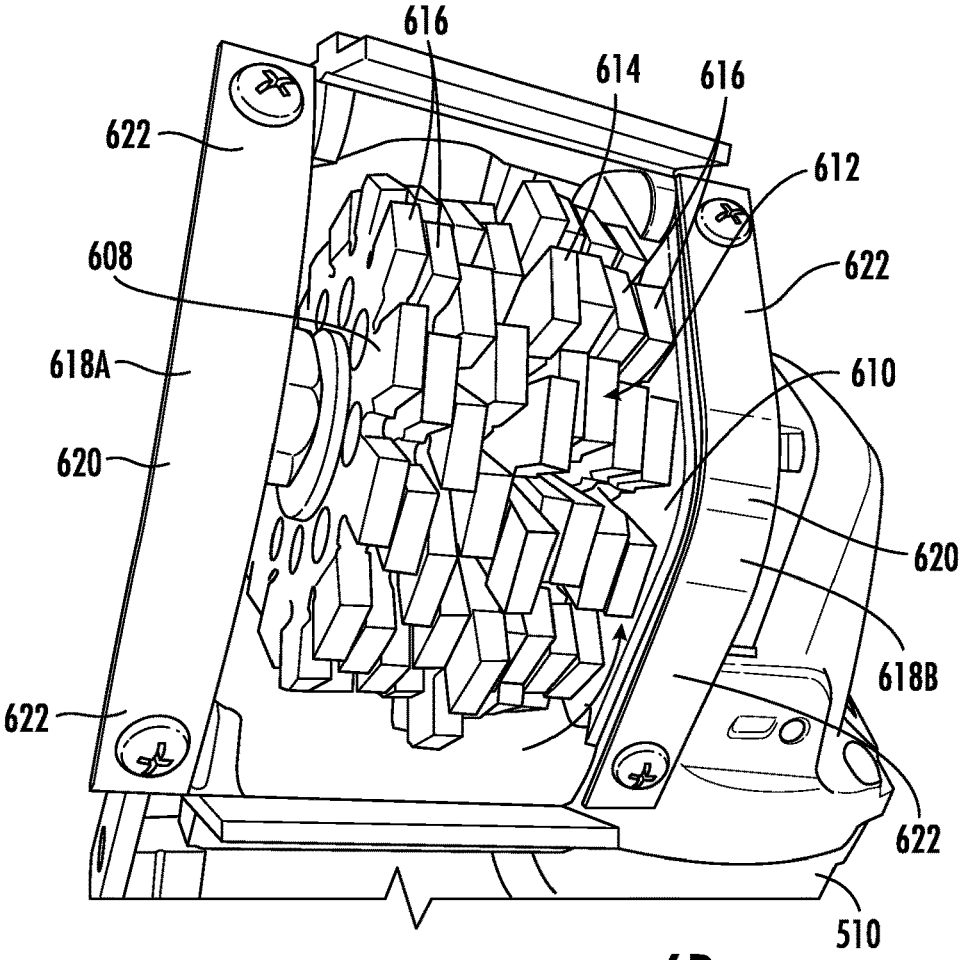
FIG. 6D is a bottom perspective view of the grinding house of FIGS. 6A-6C including the grinding drum and a pair of guides, each of the pair of guides including a strip.

FIGS. 6A-6D are views of the grinding housing 508 and grinding motor 510 of the grinding tool 502. The grinding housing 508 includes a main body 600 and a vacuum shroud 602 hingedly attached to a front of the main body 600 by a hinge 604 at a top wall 605 of the main body 600. The vacuum shroud 602 includes a vacuum port 606 for attachment to the vacuum tube 506 such that the interior of the grinding housing 508 (and the vacuum shroud 602) is in fluidic communication with the vacuum 504. In particular, the vacuum shroud 602 encloses an interior of the grinding housing 508 so that grinding dust and debris can be suctioned by the vacuum 504. The vacuum port 606 forms a right angle connection, although other types of connections can be used. For example, the right angle connection could be to the side of the grinding housing (as shown in FIGS. 6A-6B), or to the top of the grinding housing, etc.

A grinding drum 608 is at least partially positioned within the grinding housing 508. At least a portion of the grinding drum 608 protrudes outside the grinding housing 508 to grind the substrate 406 to form the nano-trench 400. The vacuum shroud 602 is movable between a closed orientation enclosing the interior of the grinding housing 508, and an open orientation providing access to the interior of the grinding housing 508 and the grinding drum 608 positioned therein. Also, in a closed orientation, the bottom of the grinding drum 608 is used to grind the substrate 406. However, moving the vacuum shroud 602 to an open orientation facilitates grinding of a vertical surface (e.g., a side of a curb) to allow grinding by the front of the grinding drum 608. In certain embodiments, the vacuum shroud 602 is fixedly attached to the grinding housing 508, such as if vertical grinding is not desired.

The grinding drum 608 is mounted to sidewalls 610 of the main body 600 of the grinding housing 508. The grinding motor 510 is mounted to one of the sidewalls 610 and is mechanically coupled through the sidewall 610 to the axle of the grinding drum 608 to rotate the grinding drum 608. In other words, the axle of the grinding drum 608 is rotatably coupled to the grinding housing 508. As noted above, the grinding drum 608 includes an axle and a blade set 612 mounted thereto, where the blade set 612 includes at least one channel blade 614 and at least one milling blade 616. In certain embodiments, the blade set 612 includes at least one channel blade 614 and a plurality of milling blades 616 on opposing sides of the at least one channel blade 614. As noted above, rotation of the plurality of milling blades 616 defines a mill curvature and a mill radius about a mill axis.

The grinding drum 608 rotates in direction R with the bottom of the blades of the blade set 612 moving forward. In other words, the grinding drum 608 grinds against the direction of travel. This facilitates grinding of the substrate 406 so that the grinding drum 608 cuts into the substrate 406 instead of pulling the grinding tool 502 over the substrate 406. Such a configuration propels dust and debris forward within the grinding housing 508. Accordingly, the vacuum port 606 is positioned at the front of the grinding housing 508 to better suction the debris and dust from within the grinding housing 508.

The grinding tool 502 includes a pair of guides 618A, 618B (referred to generally as guides 618) attached to a bottom of the grinding housing 508. The pair of guides 618 is configured to limit a grinding depth of the grinding drum 608. The pair of guides 618 are on opposing sides of the blade set 612 of the grinding drum 608. As noted above, the pair of guides 618 limits the grinding depth of the grinding drum 608.

In certain embodiments, each of the pair of guides 618 includes at least one strip (may also be referred to as a ski, a shim, etc.), which may be made of metal. In certain embodiments, the guides 618 include a curved portion 620 and at least one planar portion 622. At least a portion of the curved portion 620 of the pair of guides 618 defines the guiding curvature GC (see FIGS. 2A-2B) (which is the same or substantially similar to the mill curvature MC (see FIGS. 2A-2B)). In certain embodiments, the mill axis of the grinding drum 608 is aligned with a guide axis of the pair of guides 618 (e.g., within 10 mm). The guiding radius GR (see FIGS. 2A-2B) of the guides 618 is less than the milling radius MR (see FIGS. 2A-2B) of the milling blades 616 (and a channel radius of the channel blade 614). Thus, the pair of guides 618 limits the grinding depth of the grinding drum 608. In certain embodiments, the pair of guides 618 is configured to provide a greater grinding depth at the curved portion 620 than at the planar portion 622. Further, the guides 618 are relatively smooth so that the guides 618 merely slide over the surface to minimize interference of the guides 618 with operation and grinding by the grinding tool 502. In use, the guides 618 only contact the surface upon full grind depth. Accordingly, the guides 618 generally do not contact the surface during use, such that the guides 618 float over the surface and do not significantly contribute frictional force during use.

Figure 6E:
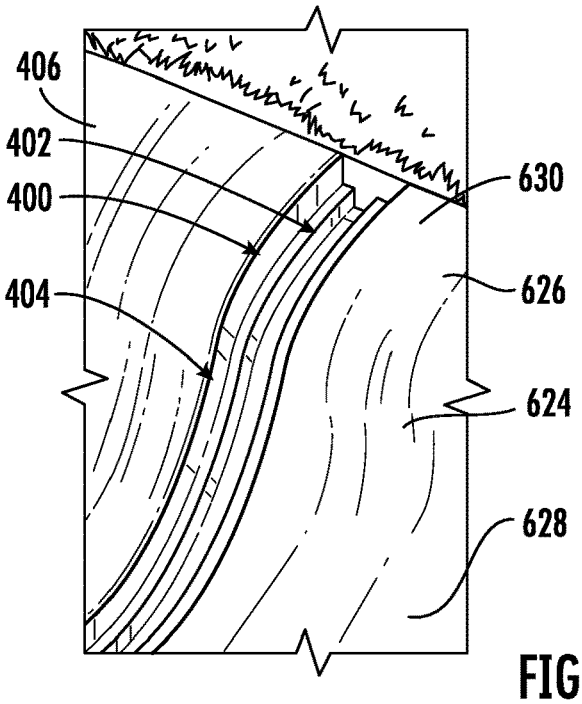
FIG. 6E is a perspective view of a nano-trench formed in a face of a curb using the grinding tool of FIGS. 5-6D.

As the grinding tool 502 is walk behind, the nano-trench 400 can be formed in a wide variety of terrain types (e.g., a road, near a curb, a curb gutter pan, a vertical curb face, a curb top surface, etc.), and in a wide variety of directions (e.g., parallel and/or perpendicular cuts near a curb). The grinding tool 502 has a relatively small footprint (e.g., less than 10 in wide), thereby facilitating grinding on a narrow pavement surface (e.g., at or near curbs) and in a multitude of directions. The grinding tool 502 can access and adjust to local contours unlike other machines with a wider stance. The grinding tool 502 may be used to provide a uniform depth of the nano-trench 400 where road contours are irregular (e.g., irregular depths, pavement undulations) in primary cable pathways and/or for lateral transitions. Further, in certain embodiments, the grinding tool 502 is devoid of sensing and/or control systems or electronics, while still being able to precisely follow dips and contours in the surface, including extreme contours (e.g., face of a monolithic curb, gutter profiles, etc.). For example, FIG. 6E is a perspective view of a nano-trench 400 formed in a face 624 of a curb 626 using the grinding tool 502 of FIGS. 5-6D. For example, the vacuum shroud 602 could be set to an open orientation to form a continuous nano-trench 400 from a bottom 628 of the curb 626, up the face 624 of the curb 626, to a top surface 630 of the curb 626. The grinding tool 502 can be used to form nano-trenches 400 and/or touch up shallow grinds formed by other machines (e.g., larger sit-on grinding machines). The grinding tool 502 is also able to form curved cuts having a radius (e.g., cuts with a 12 inch radius of curvature), such as to form a lateral nano-trench from a main roadway nano-trench.

Figure 7:
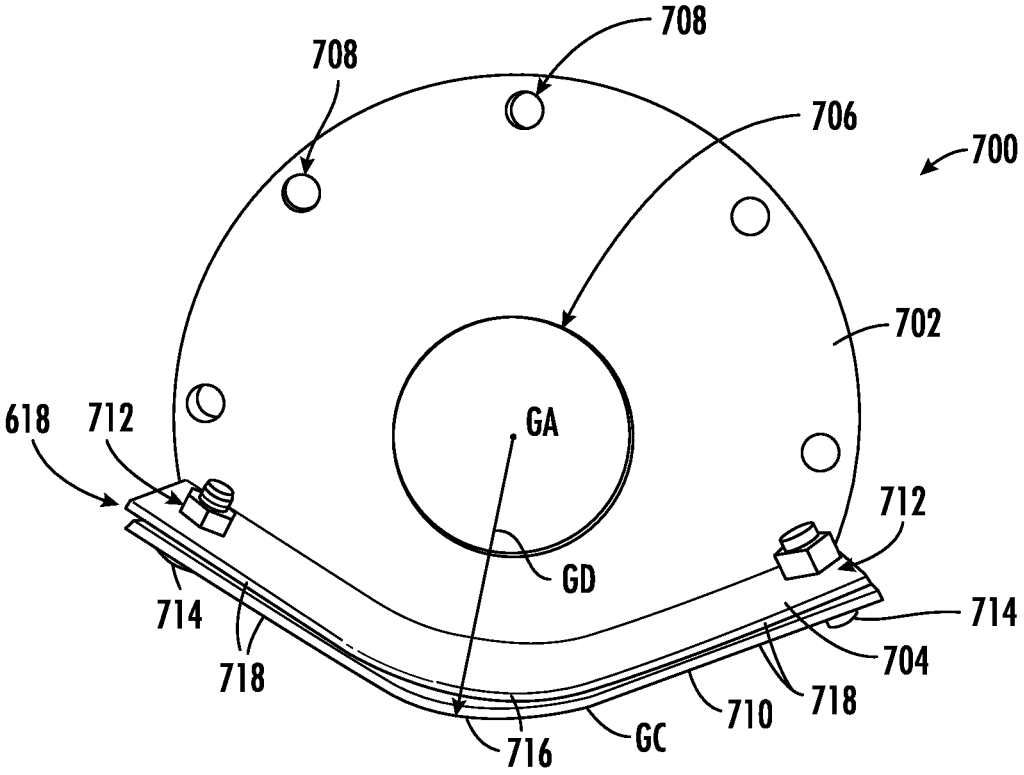
FIG. 7 is an embodiment of one of the pair of guides of FIGS. 6A-6D.

FIG. 7 is an embodiment of one of the pair of guides 618 of FIGS. 6A-6D. In certain embodiments, the grinding tool 502 includes a guide plate 700 including a mounting plate 702 with a base strip 704 (may also be referred to as a flange, a shim, etc.) extending perpendicularly therefrom. The mounting plate 702 includes a center hole 706 and a plurality of mounting holes 708. The plurality of mounting holes 708 facilitate attachment of the guide plate 700 to the grinding housing 508. The center hole 706 provides clearance for the axle of the grinding drum 608 to mount the grinding drum 608 to the grinding housing 508 and/or to couple the grinding motor 510 to the grinding drum 608. In certain embodiments, the grinding tool 502 includes a spacer strip 710 (may also be referred to as a shim, etc.) to adjust a grinding depth.

Each of the base strip 704 and the one or more spacer strips 710 includes through holes 712 at each end for attaching the one or more spacer strips 710 to an outer surface of the base strip 704 by fasteners 714. The one or more spacer strips 710 are removably attached to a bottom of the base strip 704 by the fasteners 714 (e.g., bolt and nut). Each of the base strips 704 and the one or more spacer strips 710 includes a curved portion 716 and at least one planar portion 718. The base strip 704 and/or the one or more spacer strips 710 define a guide 618 with a modular grinding depth where the grinding depth is modular and controlled by adding or removing one or more spacer strips 710. As similarly noted above, at least a portion of the curved portions 716 define a guiding curvature GC (which is the same or substantially similar to the mill curvature MC). The one or more spacer strips 710 is removable to increase the grinding depth of the grinding drum 608. For example, adding a spacer strip 710 produces a more shallow grinding depth, and removing the one or more spacer strips 710 produces a deeper grinding depth. Accordingly, as the blades 614, 616 of the grinding drum 608 wear down, the one or more spacer strips 710 may be removed to adjust the grinding depth back to an original grinding depth.

Figure 8:
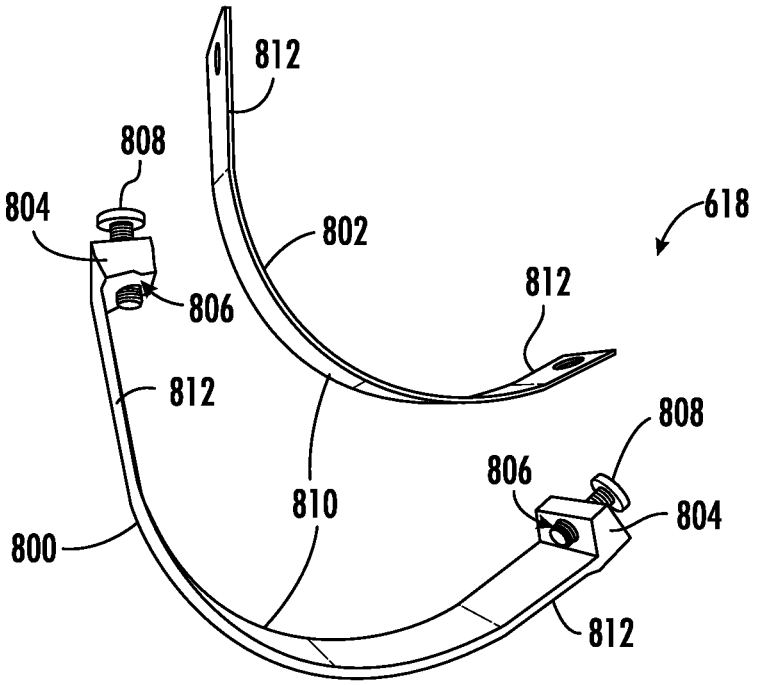
FIG. 8 is another embodiment of the one of the pair of guides of FIGS. 6A-6D.

FIG. 8 is another embodiment of one of the pair of guides 618 of FIGS. 6A-6D. In certain embodiments, the grinding tool 502 includes a base strip 800 and one or more spacer strips 802 positioned at an interior surface of the base strip 800. The base strip 800 includes mounts 804 at each end of the base strip 800 with each mount 804 defining a through hole 806 for positioning of a fastener 808 thereto to attach the base strip 800 to the grinding housing 508. As similarly noted above, each of the base strip 800 and the one or more spacer strips 802 includes a curved portion 810 and at least one planar portion 812. The base strip 800 and/or the one or more spacer strips 802 define a guide 618 with a modular grinding depth as similarly described above in FIG. 7, where the grinding depth is modular and controlled by adding or removing spacer strips 802.

In accordance with yet other aspects of the present disclosure, the pair of guides 618 and/or each guide 618A, 618B separately may be adjustable through any suitable adjustment mechanism to control the grinding depth.

Figure 9:
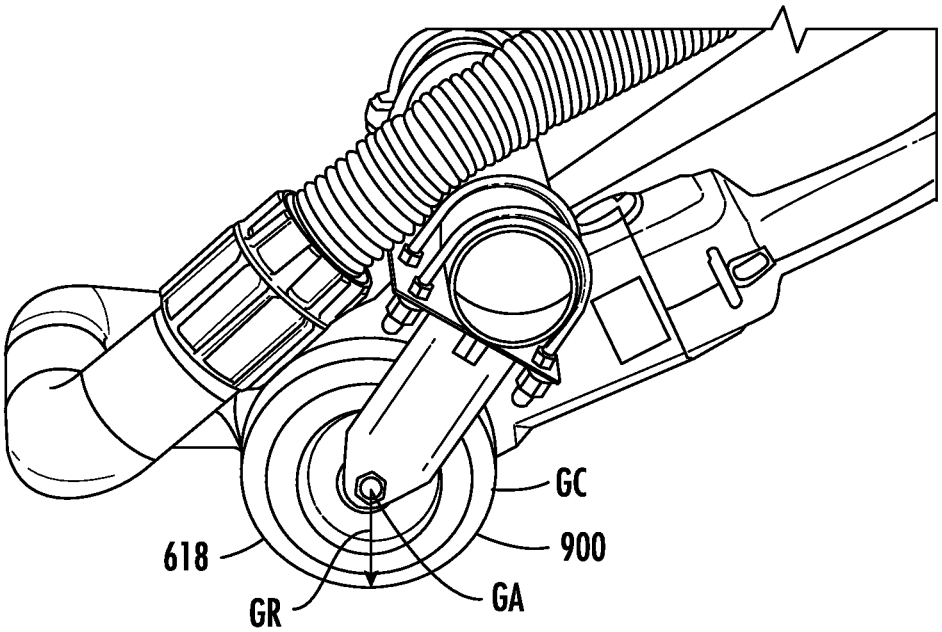
FIG. 9 is a perspective view of another embodiment of the pair of guides of FIGS. 6A-6D embodied as a pair of wheels.

FIG. 9 is a perspective view of another embodiment of the pair of guides 618 of FIGS. 6A-6D embodied as a pair of wheels 900. Each wheel 900 defines a guiding curvature GC and a guide radius GR about a guide axis GA. It is noted that while wheels 900 can be used, the strips are simpler to manufacture and assemble and result in a narrower profile.

Figure 10:
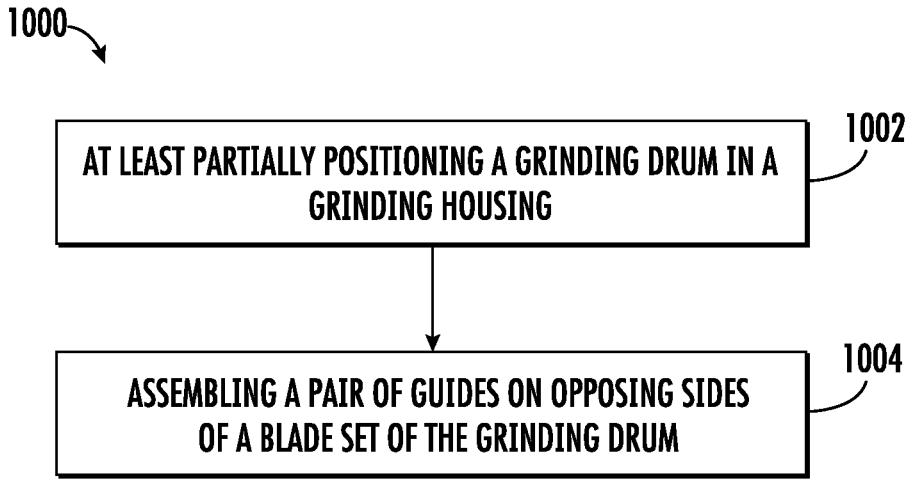
FIG. 10 is a flowchart illustrating a method of forming a grinding tool of FIGS. 5-8.

FIG. 10 is a flowchart 1000 illustrating a method of forming a grinding tool of FIGS. 5-8. Step 1002 includes at least partially positioning a grinding drum in a grinding housing. The grinding drum includes an axle and a blade set mounted thereto. The blade set includes at least one channel blade and a plurality of milling blades on opposing sides of the at least one channel blade. The axle is rotatably coupled to the grinding housing. Rotation of the plurality of milling blades defines a mill curvature and a mill radius about a mill axis. Step 1004 includes assembling a pair of guides on opposing sides of the blade set of the grinding drum, the pair of guides configured to limit a grinding depth of the grinding drum. Each of the pair of guides defines a guiding curvature and a guide radius about a guide axis, at least a portion of the guide curvature being generally concentric with the mill curvature. The guide radius is less than the mill radius.

Figure 11:
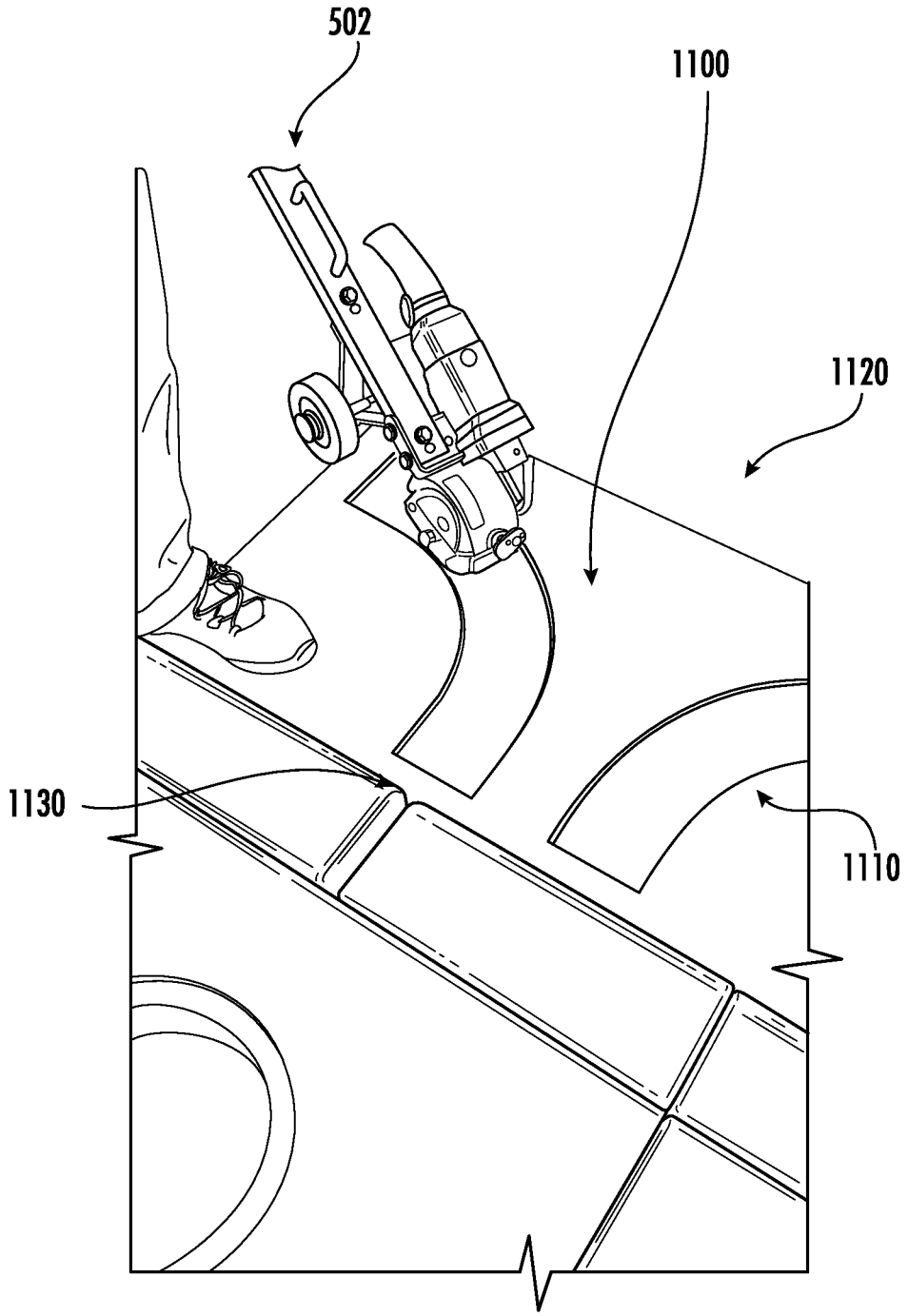
FIG. 11 is an embodiment of a grinding guide that can be used with the grinding tool of FIGS. 5-8.

FIG. 11 illustrates a grinding guide 1100 that can be used with the grinding tool 502 to define, for example, a starting position, path, and/or end position for guiding the grinding tool 502 to make a particular cut. As shown in FIG. 11, the grinding guide 1100 may be a template defining pathway constraints 1110 that accommodate the grinding tool 502 such that the grinding tool 502 is constrained to a particular path of movement. The grinding guide 1100 is particular useful in making curved trenches with a tight radius of curvature such as those types of cuts that transition from a roadway surface 1120 toward a premise or enclosure and/or toward a predetermined location 1130 in a curb or sidewalk that requires the roadway surface trench to substantially align with the predetermined location 1130. As shown in FIG. 11, the grinding guide 1100 may be a wood template with the pathway constraints 1110 being slots or channels provided therein. The pathway constraint 1110 may constrain the guides 618 of the grinding tool 502 between both sides. Although the embodiment disclosed is a template made from wood, other suitable materials may be used to make the constraining guide 1100. Moreover, constraining guide 1100 may simply be a form with one edge that forces the grinding tool 502 to follow the edge on one side. The grinding guide 1100 may be fixed in that the path or radius can only be changed by swapping in a new template. However, in accordance with other aspects of the present disclosure, the grinding guide 1100 may be adjustable by encompassing a compass point, for example, that would allow the grinding guide 1100 to rotate or move about a fixed about to define a path for the grinding tool 502 to follow. In accordance with yet other aspects of the present disclosure, the pathway constraint 1110 may comprise a rail system in which a clamp or other suitable attachment mechanism attaches the grinding guide 1100 to the rail system such that the grinding guide 1100 is forced to follow the rail to cut a particularly shaped path.

It will be apparent to those skilled in the art that various modifications and variations can be made without departing from the spirit or scope of the invention.

Further, as used herein, it is intended that terms "fiber optic cables" and/or "optical fibers" include all types of single mode and multi-mode light waveguides, including one or more optical fibers that may be upcoated, colored, buffered, ribbonized and/or have other organizing or protective structure in a cable such as one or more tubes, strength members, jackets or the like. Likewise, other types of suitable optical fibers include bend-insensitive optical fibers, or any other expedient of a medium for transmitting light signals. An example of a bend-insensitive, or bend resistant, optical fiber is ClearCurve® Multimode fiber commercially available from Corning Incorporated. Suitable fibers of this type are disclosed, for example, in U.S. Patent Application Publication Nos. 2008/0166094 and 2009/0169163.

Many modifications and other embodiments of the concepts in this disclosure will come to mind to one skilled in the art to which the embodiments pertain having the benefit of the teachings presented in the foregoing descriptions and the associated drawings. Therefore, it is to be understood that the description and claims are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A grinding tool, comprising:

a grinding housing;

a grinding drum comprising an axle and a blade set mounted thereto, the blade set comprising at least one channel blade and a plurality of milling blades on opposing sides of the at least one channel blade, the axle rotatably coupled to the grinding housing, rotation of the plurality of milling blades defining a mill curvature and a mill radius about a mill axis; and a pair of guides on opposing sides of the blade set, the pair of guides configured to limit a grinding depth of the grinding drum, each of the pair of guides defining a guiding curvature and a guide radius about a guide axis, at least a portion of the guide curvature being generally concentric with the mill curvature, the guide radius being less than the mill radius.

2. The grinding tool of claim 1, wherein the mill axis of the grinding drum is aligned with the guide axis of the pair of guides.

3. The grinding tool of claim 1, wherein the mill axis of the grinding drum is aligned with the guide axis of the pair of guides within 10 mm.

4. The grinding tool of claim 1, wherein each of the pair of guides comprise at least one strip.

5. The grinding tool of claim 4, wherein the at least one strip comprises metal.

6. The grinding tool of claim 4, wherein the at least one strip comprises a curved portion and a planar portion, the curved portion defining the guiding curvature.

7. The grinding tool of claim 6, wherein the pair of guides is configured to provide a greater grinding depth at the curved portion than at the planar portion.

8. The grinding tool of claim 1, wherein each of the pair of guides comprises at least two strips, at least one of the at least two strips being removable to increase the grinding depth of the grinding drum.

9. The grinding tool of claim 1, wherein each of the pair of guides comprises a mounting plate and a first strip extending perpendicularly from the mounting plate.

10. The grinding tool of claim 9, wherein each of the pair of guides comprises a second strip removably attached to a bottom of the first strip by a bolt.

11. The grinding tool of claim 1, wherein the pair of guides comprises a pair of wheels.

12. The grinding tool of claim 1, further comprising a pair of pivot wheels attached to and positioned rearward of the grinding housing.

13. The grinding tool of claim 1, further comprising a push handle attached to the grinding housing.

14. The grinding tool of claim 13, further comprising a control interface at an end of the push handle, the control interface comprising at least one switch to control operation of a grinding motor configured to rotate the grinding drum.

15. The grinding tool of claim 1, further comprising a grinding motor attached to a side of the grinding housing and configured to rotate the grinding drum.

16. The grinding tool of claim 1, wherein the grinding housing comprises a vacuum shroud at a front of the grinding housing.

17. The grinding tool of claim 1, wherein the grinding housing comprises a main body and a vacuum shroud hingedly attached to a front of the main body.

18. The grinding tool of claim 1, further comprising:

a push handle attached to the grinding housing;

a pair of pivot wheels attached to the push handle and positioned rearward of the grinding housing; and a grinding motor attached to a side of the grinding housing and configured to rotate the grinding drum;

wherein the grinding housing comprises a main body and a vacuum shroud hingedly attached to a front of the main body; and wherein each of the pair of guides comprises at least one metal strip having a curved portion and a planar portion, the curved portion defining the guiding curvature.

19. A grinding system, comprising:

a grinding tool, comprising:

a grinding housing comprising a main body and a vacuum shroud hingedly attached to a front of the main body;

a grinding drum comprising an axle and a blade set mounted thereto, the blade set comprising at least one channel blade and a plurality of milling blades on opposing sides of the at least one channel blade, the axle rotatably coupled to the grinding housing, rotation of the plurality of milling blades defining a mill curvature and a mill radius about a mill axis;

a pair of guides on opposing sides of the blade set, the pair of guides configured to limit a grinding depth of the grinding drum, each of the pair of guides defining a guiding curvature and a guide radius about a guide axis, at least a portion of the guide curvature being generally concentric with the mill curvature, the guide radius being less than the mill radius;

a grinding motor attached to a side of the grinding housing and configured to rotate the grinding drum; and a vacuum comprising a vacuum tube in fluid communication with the vacuum shroud.

20. A method of forming a grinding tool, comprising:

at least partially positioning a grinding drum in a grinding housing, the grinding drum comprising an axle and a blade set mounted thereto, the blade set comprising at least one channel blade and a plurality of milling blades on opposing sides of the at least one channel blade, the axle rotatably coupled to the grinding housing, rotation of the plurality of milling blades defining a mill curvature and a mill radius about a mill axis; and assembling a pair of guides on opposing sides of the blade set, the pair of guides configured to limit a grinding depth of the grinding drum, each of the pair of guides defining a guiding curvature and a guide radius about a guide axis, at least a portion of the guide curvature being generally concentric with the mill curvature, the guide radius being less than the mill radius.

* * * * *